US009391378B2

(12) United States Patent
Leddige et al.

(10) Patent No.: US 9,391,378 B2
(45) Date of Patent: Jul. 12, 2016

(54) HIGH BANDWIDTH CONNECTOR FOR INTERNAL AND EXTERNAL IO INTERFACES

(75) Inventors: Michael Leddige, Beaverton, OR (US); Yun Ling, Portland, OR (US); Kuan-Yu Chen, Portland, OR (US); Kai Wang, Portland, OR (US); Xiang Li, Portland, OR (US); Howard Heck, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 13/996,004

(22) PCT Filed: Dec. 23, 2011

(86) PCT No.: PCT/US2011/067163

§ 371 (c)(1),
(2), (4) Date: Jul. 11, 2014

(87) PCT Pub. No.: WO2013/095628

PCT Pub. Date: Jun. 27, 2013

(65) Prior Publication Data

US 2014/0377968 A1 Dec. 25, 2014

(51) Int. Cl.
*H01R 4/48* (2006.01)
*H01R 12/72* (2011.01)
(Continued)

(52) U.S. Cl.
CPC ..... *H01R 4/48* (2013.01); *H01R 12/71* (2013.01); *H01R 12/721* (2013.01); *H01R 13/24* (2013.01); *H01R 13/6658* (2013.01); *H01R 43/18* (2013.01); *H01R 12/716* (2013.01); *Y10T 29/49208* (2015.01)

(58) Field of Classification Search
USPC ..... 439/78, 660, 77, 76.1, 66, 630; 324/538
See application file for complete search history.

(56) References Cited

U.S. PATENT DOCUMENTS 4,871,319 A * 10/1989 Babow ..... 439/77
5,092,783 A * 3/1992 Suarez et al. ..... 439/71

(Continued)

FOREIGN PATENT DOCUMENTS

EP 1833284 A1 9/2007
KR 10-2006-0087616 A 8/2006

(Continued)

OTHER PUBLICATIONS

Extended European Search Report received for EP application No. 11877654.1, mailed on Jul. 20, 2015, 6 pages.

(Continued)

*Primary Examiner* — Alexander Gilman
(74) *Attorney, Agent, or Firm* — Jordan IP Law, LLC

(57) ABSTRACT

Methods and systems to support input output (IO) communications may include an IO connector having a housing with surfaces defining a paddle card region, and a set of compressible contacts extending vertically through the housing into the paddle card region. In addition, an IO interconnect can include a cable portion and at least one end portion coupled to the cable portion. The end portion may include a paddle card having a circuit board with a set of contacts disposed on a bottom surface of the circuit board. The end portion can also include an asymmetric metal shell having a configuration that encloses at least a portion of the paddle card and exposes the set of contacts.

11 Claims, 4 Drawing Sheets

(51) Int. Cl.

| | |
|---|---|
| ***H01R 13/24*** | (2006.01) |
| ***H01R 12/71*** | (2011.01) |
| ***H01R 43/18*** | (2006.01) |
| ***H01R 13/66*** | (2006.01) |

(56) References Cited

U.S. PATENT DOCUMENTS

| | | | | |
|---|---|---|---|---|
| 6,079,988 | A * | 6/2000 | Hashiguchi et al. | 439/66 |
| 6,083,051 | A * | 7/2000 | Chang | 439/660 |
| 6,186,830 | B1 * | 2/2001 | Lin et al. | 439/607.4 |
| 6,544,072 | B2 * | 4/2003 | Olson | 439/607.02 |
| 6,743,058 | B1 * | 6/2004 | Cui et al. | 439/733.1 |
| 6,893,270 | B2 * | 5/2005 | Sercu | 439/76.1 |
| 7,459,985 | B2 * | 12/2008 | Mellitz et al. | 333/5 |
| 7,481,679 | B1 * | 1/2009 | Stotz et al. | 439/638 |
| 7,604,508 | B1 * | 10/2009 | Harlan et al. | 439/630 |
| 8,047,865 | B2 * | 11/2011 | Patel et al. | 439/499 |
| 8,466,365 | B2 * | 6/2013 | Gundel | 174/110 R |
| 8,840,432 | B2 * | 9/2014 | Alden et al. | 439/607.46 |
| 2002/0009906 | A1 | 1/2002 | Akama et al. | |
| 2007/0232091 | A1 * | 10/2007 | Hong | 439/66 |
| 2011/0070750 | A1 | 3/2011 | Reisinger et al. | |
| 2011/0212633 | A1 | 9/2011 | Regnier et al. | |

FOREIGN PATENT DOCUMENTS

| | | | |
|---|---|---|---|
| WO | 2009155494 | A1 | 12/2009 |
| WO | 2013/095628 | A1 | 6/2013 |

OTHER PUBLICATIONS

International Preliminary Report on Patentability and Written Opinion received for PCT Patent Application No. PCT/US2011/067163, mailed on Jul. 3, 2014, 8 pages.

International Search Report and Written Opinion received for PCT application No. PCT/US2011/067163, mailed on Feb. 18, 2013, 16 pages.

* cited by examiner

HIGH BANDWIDTH CONNECTOR FOR INTERNAL AND EXTERNAL IO INTERFACES

BACKGROUND

1. Technical Field

Embodiments generally relate to input/output (IO) interfaces and interconnects. More particularly, embodiments relate to a high bandwidth connector configuration for IO interfaces and interconnects.

2. Discussion

Computing systems may include one or more USB (Universal Serial Bus, e.g., USB Specification 3.0, Rev. 1.0, Nov. 12, 2008, USB Implementers Forum) ports to support IO communication with peripheral components such as flash drives, keyboards, mice, cameras, and so forth. Future platforms and peripheral components, however, may demand higher bandwidths than offered by current solutions.

BRIEF DESCRIPTION OF THE DRAWINGS

The various advantages of the embodiments of the present invention will become apparent to one skilled in the art by reading the following specification and appended claims, and by referencing the following drawings, in which:

DETAILED DESCRIPTION

Embodiments may include an input/output (IO) connector having a housing with surfaces defining a paddle card region. The IO connector may also have a set of compressible contacts extending vertically through the housing into the paddle region.

Embodiments may also include a system having a motherboard and an IO connector mounted to the motherboard. The IO connector can include a housing having surfaces defining a paddle card region, and a set of compressible contacts extending vertically from the motherboard through the housing and into the paddle card region.

Additionally, embodiments can include a method of fabricating an IO connector. The method may involve providing a housing that includes surfaces defining a paddle card region, and extending a set of compressible contacts vertically through the housing into the paddle card region.

Other embodiments may include an IO interconnect hair a cable portion and at least one end portion coupled to the cable portion. The at least one end portion may include a paddle card having a circuit board with a set of contacts disposed on a bottom surface of the paddle card, and an asymmetric metal shell having a configuration that encloses at least as portion of the paddle card and exposes the set of contacts.

Figure 1:
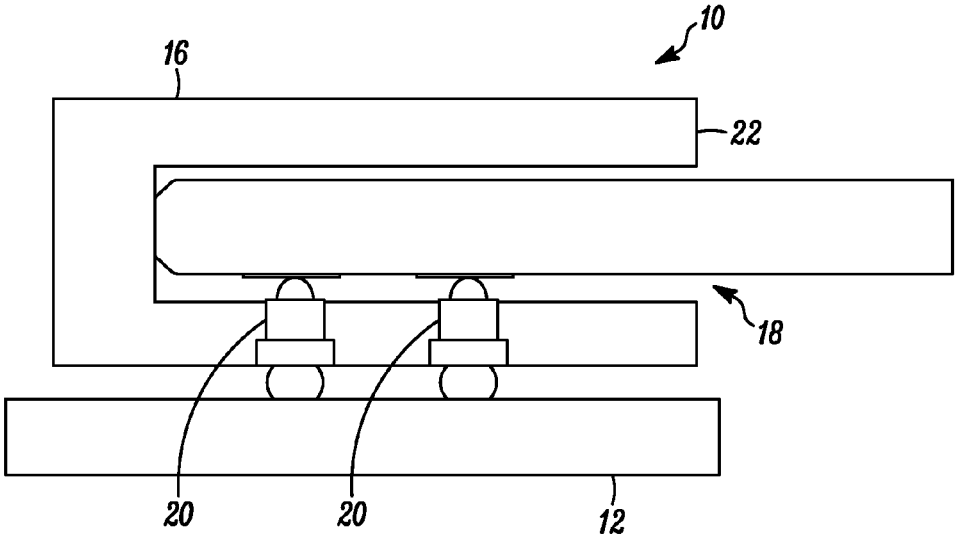
FIG. 1 is a sectional side view of an example of an IO connector having spring loaded pins according to an embodiment.

Turning now to FIG. 1, an IO connector 10 is shown. The illustrated connector 10 is coupled to a circuit board 12 and a paddle card 14 that is located at a proximal end of an interconnect such as a copper wire or fiber waveguide cable (not shown). In one example, the IO connector 10 facilitates the transport of IO signals between one or more components (not shown) mounted on the circuit board 12 and one or more components not shown) coupled to a distal end of the interconnect. Thus, the IO connector 10 might enable a flash drive, keyboard, mouse, camera, and so forth, to communicate with a computing system that contains the circuit board 12.

Generally, the IO connector 10 may include a housing 16 having surfaces defining a paddle card region 18, and a set of compressible contacts extending vertically from the circuit board 12 through the housing 16 and into the paddle card region 18. In the illustrated example, the compressible contacts are spring loaded (e.g., "pogo") pins 20 that make contact with a corresponding set of contacts on a bottom side of the paddle card 14 if the paddle card 14 is inserted into the paddle card region 18. The spring loaded pins 20 of the IO connector 10, which may be mounted to the circuit board 12 via surface mount technology (SMT), through-hole technology, etc., enable the physical and electrical distance between the paddle card 14 and the circuit board 12 to be very small. The reduced distance between the paddle card 14 and the circuit board 12 may in turn minimize the electrical parasitic inductance and capacitance associated with the IO connector 10, and improve channel performance with regard to data rate (e.g., bandwidth) and power efficiency. For example, each spring loaded pin 20 may have an inductance that does not exceed a predetermined threshold (e.g., on the order of 0.5 nH or less), whereas conventional IO connector configurations may have contacts with inductances of 3 nH or more.

The spring loaded pins 20 may also be arranged in a plurality of rows (e.g., extending into the page), wherein each row is substantially parallel to a connection edge 22 of the housing 16. Such an architecture may enable a substantial increase in signaling density (e.g., by extending rows of contacts deeper into the connector) without concern over parasitic inductance and capacitance drawbacks.

Figure 2:
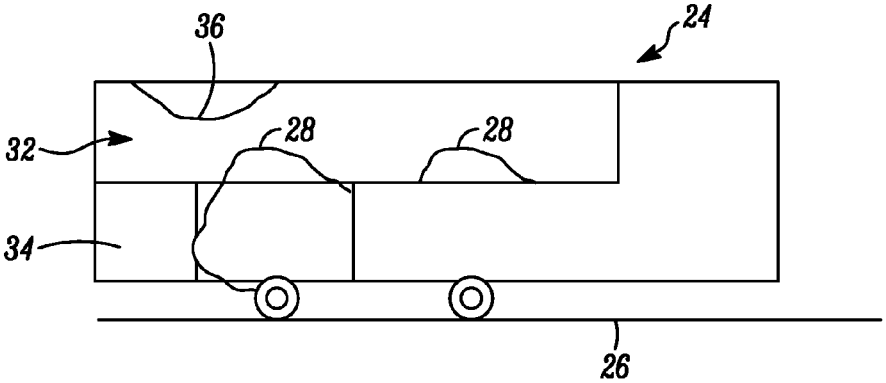
FIG. 2 is a sectional side view of an example of an IO connector having C-shaped contacts according to an embodiment.

FIG. 2 shows an IO connector 24 that is coupled to a circuit board 26 and configured to receive a paddle card (not shown). In the illustrated example, the compressible contacts are C-shaped contacts 28 that extend vertically from the circuit board 26 through a housing 30 and into a paddle card region 32 of the housing 30. The compressible contacts may be implemented using other compressible solutions as well. In the illustrated example, the C-shaped contacts 28 are staggered in separate rows that are substantially parallel to a connection edge 34 of the housing 30. Such a staggered configuration may reduce wear on the contacts 28 that might otherwise result from repeated insertions of paddle cards over time. The illustrated IO connector 24 also includes a retention protrusion 36 that extends into the paddle card region 32 and biases the paddle card in the connected state after insertion. The C-shaped contacts 28 may also have a substantially reduced inductance (e.g., (0.5 nH or less) due to the reduced distance between the circuit board 26 and the paddle card.

Figure 3:
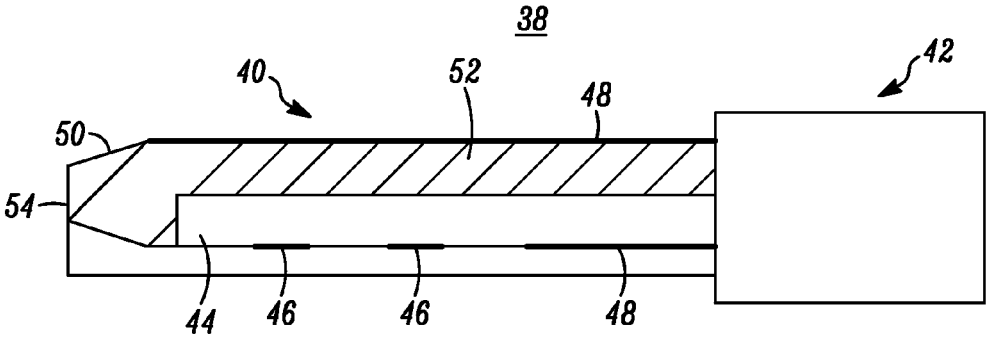
FIG. 3 is a sectional side view of an example of an end portion of an IO interconnect according to an embodiment.

Turning now to FIG. 3, an end portion 3 of an IO interconnect that may be inserted into an IO connector such as the IO connector 10 (FIG. 1) or the IO connector 24 (FIG. 2), already discussed. In general, the IO interconnect may include a cable portion (not shown) such as a copper wire or fiber waveguide cable coupled to the end portion 38, wherein the end portion 38 may include a paddle card 40 and a plastic overmold 42 that encompasses at least a portion of the paddle card 40. More particularly, the illustrated paddle card 40 includes a circuit board 44 having a set of contacts 46 disposed on a bottom surface of the circuit board 44. Thus, the contacts 46 may be configured to mate with a set of compressible contacts such as the spring loaded pins 20 (FIG. 1) or the C-shaped contacts 28 (FIG. 2), already discussed. Of particular note is that the positioning of the illustrated contacts 46 on the bottom of the circuit board 44 enables the connection distance to be minimized, which can further improve channel performance with regard to data rate and power efficiency.

The paddle card 40 may also include an asymmetric metal shell 48 that extends a majority of the longitudinal distance of the paddle card 40 on the top side of the paddle card 40, and exposes the set of contacts 46 on the bottom side of the paddle card 40. Thus, exposing the set of contacts 46 can further reduce the connection distance associated with the end portion 38 and may significantly enhance performance.

In addition, the illustrated paddle card 40 includes a plastic frame 52 having a tapered tip 50, wherein the plastic frame 52 may provide structural rigidity to the circuit board 44 and bias the circuit board 44 toward the compressible contacts of the IO connector (not shown). Moreover, the tapered tip 50 can further mechanically bias the circuit board 44 (e.g., flexing it downward) during insertion of the paddle card 40 into the IO connector. As in the case of the compressible contacts, the illustrated set of contacts 46 may be arranged in a plurality of rows that are substantially parallel to a connection edge 54 of the paddle card 40 in order to facilitate greater signaling density. The circuit board 44 may be a multi-layer circuit board containing one or more traces that route signals from the contacts 46 to the cable portion of the IO interconnect. The paddle card 40 may be retractable within the overmold 42 to provide enhanced protection to the contacts 46 (e.g., against dust, scratches, damage, etc.).

Figure 4A:
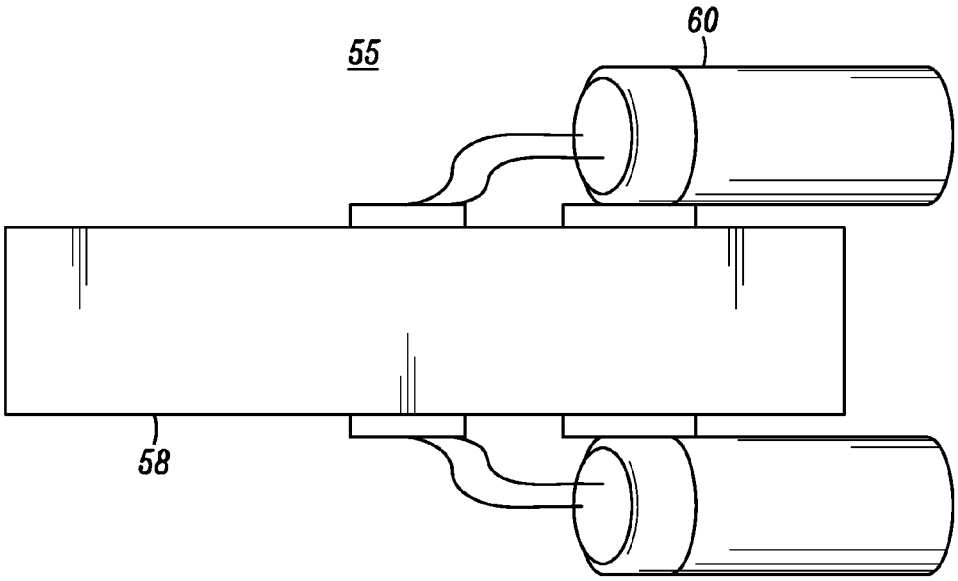
FIG. 4A is a side view of an example of a circuit board having a double-sided connection with a cable portion of an interconnect according to an embodiment.

FIG. 4A shows an assembly 55 of an IO interconnect, wherein the assembly 55 may be located at an interface between a cable portion 60 and a circuit board 58 such as the circuit board 44 (FIG. 3), already discussed. In particular, the circuit board 58 may have a double-sided connection with the cable portion 60 of the IO interconnect. Thus, in the illustrated example, some of the contacts of the end portion (not shown) are routed to the bottom side of the circuit board 58, whereas other contacts of the end portion are routed to the top side of the circuit board 58.

Figure 4B:
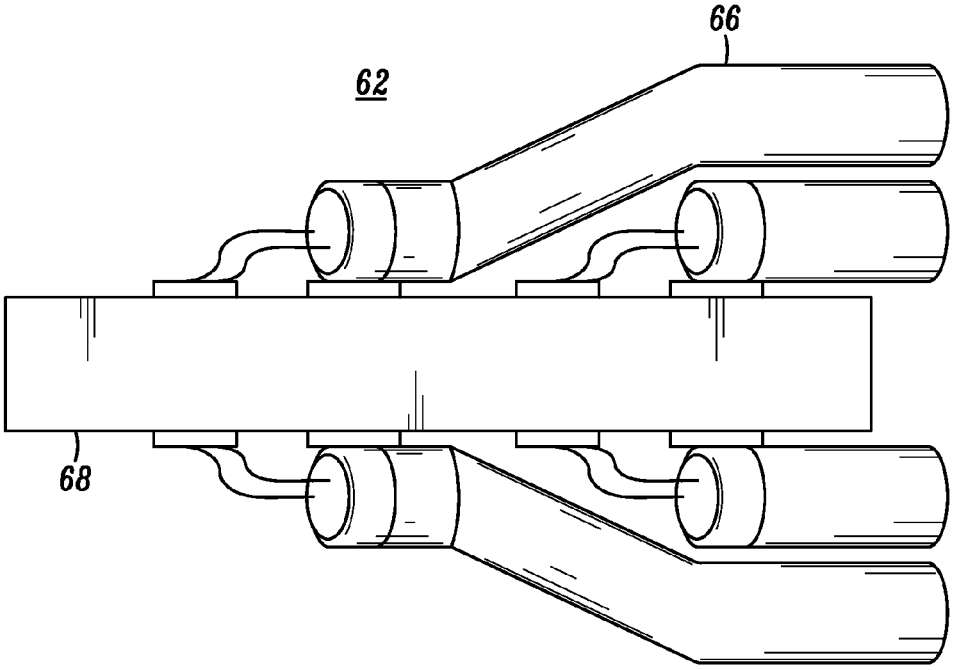
FIG. 4B is a side view of an example of a circuit board having a double-sided and shingled connection with a cable portion of an interconnect according to an embodiment.

FIG. 4B shows an assembly 62 of an IO interconnect, wherein the assembly 62 may be located at an interface between a cable portion 66 and a circuit board 68 such as the circuit board. 44 (FIG. 3), already discussed. In the illustrated example, the circuit board 68 has a double-sided and "shingled" connection with the cable portion 66 of the IO interconnect. In particular, some of the wires partially overlay other wires similar to roof shingles in the example shown.

Figure 5:
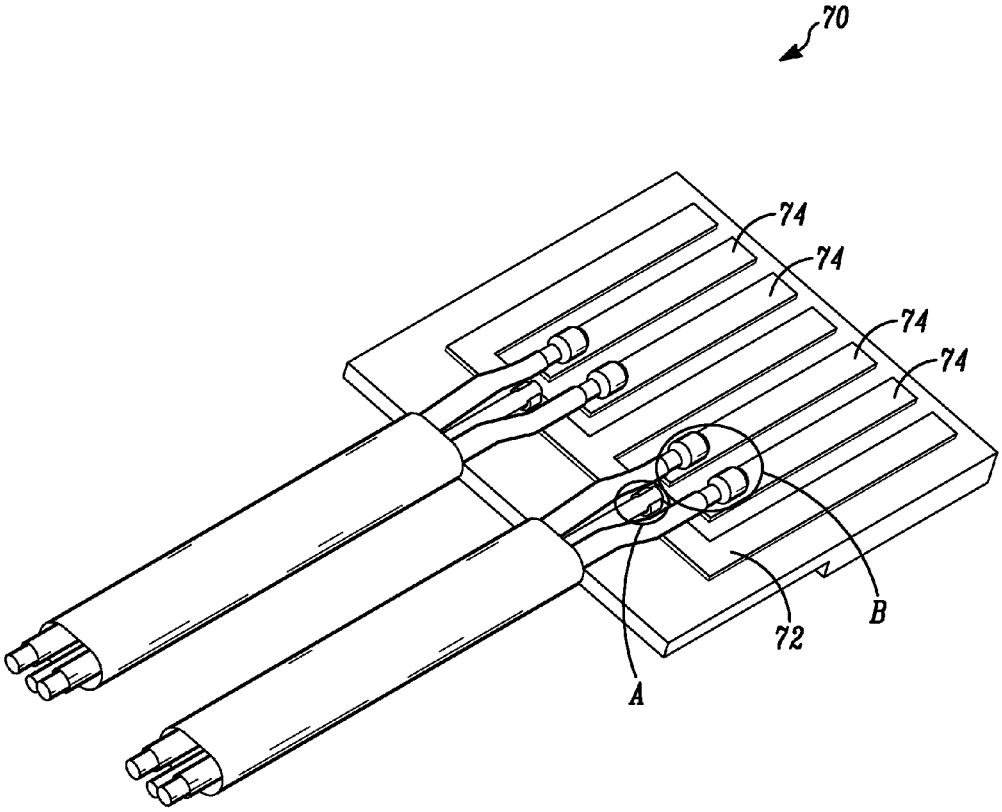
FIG. 5 is a perspective view of an example of a paddle card circuit board according to an embodiment.

Turning now to FIG. 5, an assembly 70 is shown in which a cable portion of an IO interconnect includes ground and drain wires that are directly soldered (e.g., in the encircled region "A") to one or more shield lines 72. Additionally, differential pairs of the cable portion may be soldered (e.g., in the encircled region "B") directly to traces 74. In one example, ground is positioned relatively close to the cable end of the termination to reduce ground/drain inductance. Moreover, the illustrated shield hoes 72 are configured in strips in order to reduce crosstalk between differential pairs. The illustrated circuit board may have a flexible or rigid circuitry configuration, and direct current (DC) power distribution of one or more power domains and ground may be achieved through traces or large plane shapes on the top side of the circuit board, which may further enhance the ability to control the impedance of the signal traces.

Figure 6:
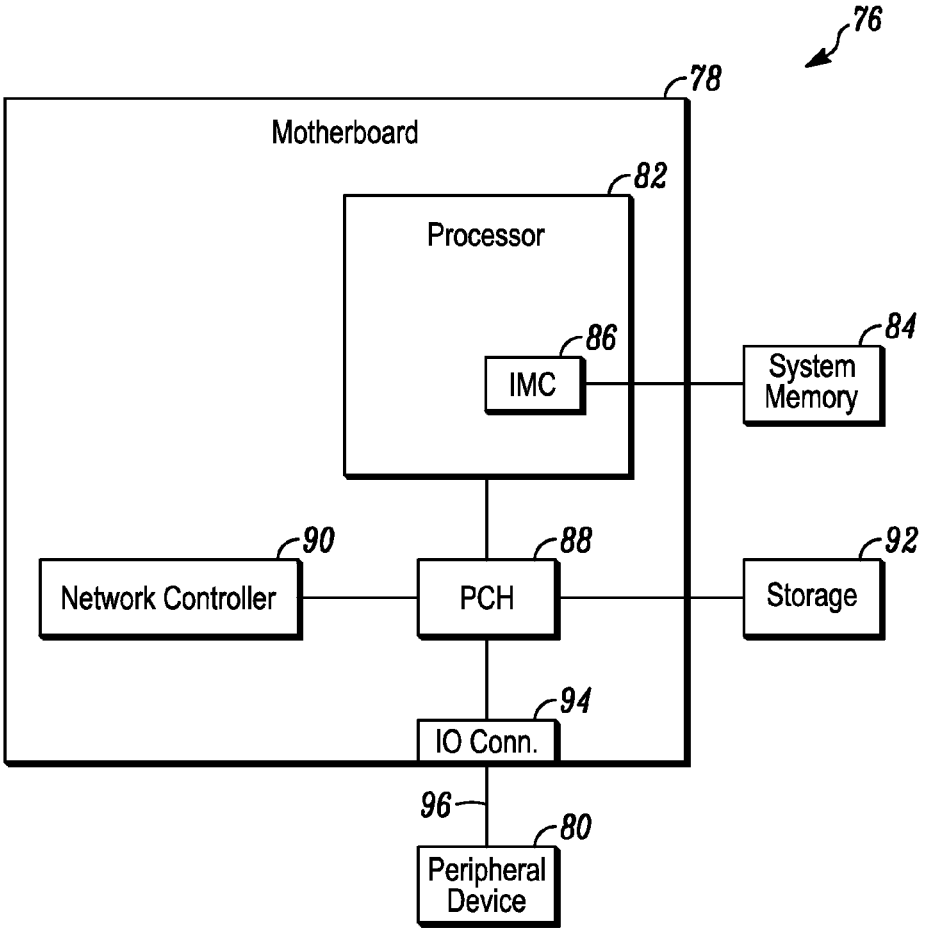
FIG. 6 is a block diagram of an example of a system according to an embodiment.

FIG. 6 shows a system 76 having a motherboard 78 coupled to a peripheral device 80. The system 76 could include, for example, a personal digital assistant (PDA), mobile Internet device (MID), wireless smart phone, media player, imaging device, smart tablet, laptop computer, desktop personal computer (PC), server, etc., or any combination thereof. In general, the peripheral device 80 may include, for example, a flash drive, keyboard, mouse, camera, PDA, MID, wireless smart phone, media player, imaging device, smart tablet, etc., or any combination thereof.

In the illustrated example, the motherboard 78 includes one or more processors 82 coupled to system memory 84, which could include, for example, double data rate (DDR) synchronous dynamic random access memory (SDRAM, e.g., DDR3 SDRAM JEDEC Standard JESD79-3C, April 2008) modules. One or more of the modules of the system memory 84 may be incorporated into a single inline memory module (SIMM), dual inline memory module (DIMM), small outline DIMM (SODIMM), and so forth. In particular, the processor 82 may have an integrated memory controller (IMC) 86 to facilitate the storage and retrieval of data, and one or more processor cores (not shown) to execute one or more drivers associated with a host OS (operating system) and/or application software, wherein each core may be fully functional with instruction fetch units, instruction decoders, level one (L1) cache, execution units, and so forth. The processor 82 could alternatively communicate with an off-chip variation of the IMC 86, also known as a Northbridge, via a front side bus. The illustrated processor 82 communicates with a platform controller hub (PCH) 88, also known as a Southbridge, via a hub bus. The IMC 86/Processor 82 and the PCH 88 are sometimes referred to as a chipset.

The illustrated motherboard 78 also includes a network controller 90 that may enable off-platform communication via a wide variety of wired and/or wireless techniques. The PCH 88 may also communicate with mass storage 92 (e.g., hard disk drive/HDD, optical disk, etc.) in order to further facilitate the storage and retrieval of data.

The motherboard 78 may also include an IO connector 94 configured similarly to, for example, the IO connector 10 (FIG. 1) or the IO connector 24 (FIG. 2), already discussed. Thus, the illustrated IO connector 94 may include a housing having surfaces defining a paddle card region, and a set of compressible contacts extending vertically through the housing into the paddle region. Additionally, the IO connector 94 may be mated with an IO interconnect 96 that includes a cable portion and one or more end portions having a paddle card and an asymmetric metal shell. In one example, the paddle card has a circuit board with a set of contacts disposed on a bottom surface of the circuit board, and the asymmetric metal shell has a configuration that exposes the set of contacts for mating with the compressible contacts of the IO connector 94.

Figure 7:
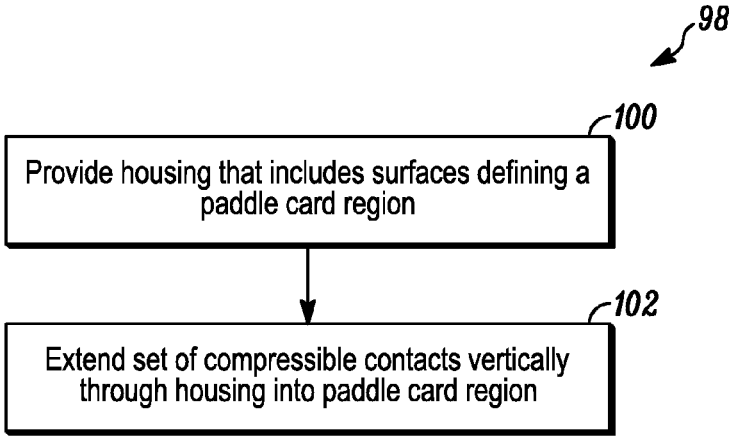
FIG. 7 is a flowchart of an example of a method of fabricating an IO connector according to an embodiment.

Turning now to FIG. 7, a method 98 of fabricating an IO connector is shown. The method 98 may be implemented using one or more well-documented fabrication technologies such as, for example, plastics injection molding, metal stamping, and so forth. Illustrated processing block 100 provides a housing that includes surfaces defining a paddle card region, and block 102 may extend a set of compressible contacts vertically through the housing and into the paddle region. The compressible contacts may include, for example, spring loaded pins, C-shaped contacts, etc., as already discussed.

The method 98 may also involve fabricating an IO interconnect. In such a case, the method 98 could also include coupling at least one end portion to a cable portion, wherein the end portion includes a paddle card having a circuit board with a set of contacts disposed on a bottom surface of the circuit board, and an asymmetric metal shell having a configuration that encloses at least a portion of the paddle card and exposes the set of contacts.

Embodiments of the present invention are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments of the present invention are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments of the invention. Further, arrangements may be shown in block diagram form in order to avoid obscuring embodiments of the invention, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments of the invention, it should be apparent to one skilled in the art that embodiments of the invention can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. might be used herein only to facilitate discussion, and carry no particular temporal or chronological significance unless otherwise indicated.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

We claim:

1. A system comprising:

a motherboard; and an input output (IO) connector mounted to the motherboard, wherein the IO connector includes, a housing having surfaces defining a paddle card region, and a set of compressible contacts, each contact including a first contact element that is axially displaceable with respect to a second contact element and having an axially compressible spring therebetween, the set of compressible contacts extending predominately vertically from the motherboard through the housing and into the paddle card region, wherein each contact in the set of compressible contacts is to have an inductance that is less than a predefined threshold amount, wherein the predefined threshold amount is 3 nH.

2. The system of claim 1, wherein the set of compressible contacts includes one or more spring loaded pins that are axially displaceable along a direction that is orthogonal to the motherboard.

3. The system of claim 1, wherein the set of compressible contacts is arranged in a plurality of rows that are substantially parallel to a connection edge of the housing.

4. The system of claim 1, further including a retention protrusion extending into the paddle card region.

5. The system of claim 1, wherein the set of compressible contacts is to transport one or more IO signals between the motherboard and the IO connector.

6. The system of claim 1, wherein the predefined threshold amount is about 0.5 nH or less.

7. The system of claim 1, wherein the predefined threshold amount is to be defined by a distance between the motherboard and a paddle card.

8. An input output connector comprising:

a housing including surfaces defining a paddle card region; and a set of compressible contacts, each contact including a first contact element that is axially displaceable with respect to a second contact element and having an axially compressible spring therebetween, the set of compressible contacts extending predominately vertically through the housing into the paddle card region, wherein each contact in the set of compressible contacts is to have an inductance that is less than a predefined threshold amount, wherein the predefined threshold amount is 3 nH.

9. The connector of claim 8, wherein the set of compressible contacts includes one or more spring loaded pins that are axially displaceable along a direction that is orthogonal to the housing through which the spring loaded pins extend.

10. The connector of claim 8, wherein the set of compressible contacts is arranged in a plurality of rows that are substantially parallel to a connection edge of the housing.

11. The connector of claim 8, further including a retention protrusion extending into the paddle card region.

* * * * *